US006886694B2

(12) United States Patent
McNeeley et al.

(10) Patent No.: US 6,886,694 B2
(45) Date of Patent: May 3, 2005

(54) NESTABLE FOOD STORAGE LIDS AND CONTAINER BASE

(75) Inventors: Carolyn M. McNeeley, Brunswick, OH (US); Leighann Sturgin, Wadsworth, OH (US)

(73) Assignee: Rubbermaid Incorporated, Wooster, OH (US)

( * ) Notice: Subject to any disclaimer, the term of this patent is extended or adjusted under 35 U.S.C. 154(b) by 146 days.

(21) Appl. No.: 10/056,433

(22) Filed: Jan. 23, 2002

(65) Prior Publication Data

US 2003/0136699 A1 Jul. 24, 2003

(51) Int. Cl.[7] ..... B65D 21/02

(52) U.S. Cl. ..... 206/505; 206/508; 206/509; 220/781; 220/23.86

(58) Field of Search ..... 220/23.56; 206/508, 206/501, 499, 515, 505, 509, 781, 23.86

(56) References Cited

U.S. PATENT DOCUMENTS

| | | | |
|---|---|---|---|
| 1,778,175 | A | 10/1930 | Thune |
| 2,412,325 | A | 12/1946 | Devine et al. |
| 2,816,589 | A | 12/1957 | Tupper |

(Continued)

FOREIGN PATENT DOCUMENTS

| | | |
|---|---|---|
| FR | 2 024 946 | 11/1969 |
| GB | 2110 074 A | 6/1983 |

OTHER PUBLICATIONS

PCT International Written Opinion issued in PCT/US03/00216, mailed Sep. 19, 2003.
English translation of FR 2 024 946, already of record.
PCT International Written Opinion issued in PCT/US03/00216, mailed Jan. 20, 2004.

*Primary Examiner*—Joseph Man-Fu Moy
(74) *Attorney, Agent, or Firm*—Marshall, Gerstein & Borun LLP

(57) ABSTRACT

A nestable and stackable food storage container has a base with a bottom panel. The bottom panel has an upper side, a lower side, and a base perimeter. The base also has a cylindrical side wall extending generally upward from and around the base perimeter. The side wall terminates at a top edge and defines an open top. A lid has a top panel with a top side, a bottom side, and a lid perimeter. A nesting structure is provided at least in part on a portion of the base and at least in part on a portion of the lid. The nesting structure permits removably nesting the lower side of the base with the lid in either a standard lid orientation or an inverted lid orientation.

13 Claims, 8 Drawing Sheets

U.S. PATENT DOCUMENTS

| | | | |
|---|---|---|---|
| 3,384,265 | A | 5/1968 | Frank |
| 3,557,995 | A | 1/1971 | Mirasol et al. |
| 3,598,271 | A | 8/1971 | Holley |
| 3,606,074 | A | 9/1971 | Hayes |
| 3,815,736 | A | 6/1974 | Sedlak |
| 3,912,118 | A | 10/1975 | Bird |
| 3,931,890 | A | 1/1976 | Davis |
| 3,989,142 | A | 11/1976 | Gwilliam, Jr. et al. |
| D243,379 | S | 2/1977 | Meeks |
| 4,047,329 | A | 9/1977 | Holt |
| D247,839 | S | 5/1978 | Ashton |
| 4,144,968 | A | 3/1979 | Shelton |
| D256,310 | S | 8/1980 | Daenen |
| 4,275,815 | A | 6/1981 | Davis |
| 4,372,526 | A | 2/1983 | Daenen |
| 4,600,253 | A | 7/1986 | Pongsengsook |
| 4,700,842 | A | 10/1987 | Grusin |
| 4,844,263 | A | 7/1989 | Hadtke |
| 4,951,832 | A | 8/1990 | Tenney et al. |
| 5,150,804 | A | 9/1992 | Blanchet et al. |
| 5,184,745 | A | 2/1993 | Havens et al. |
| 5,215,775 | A | 6/1993 | Hoffman, Jr. |
| 5,287,979 | A | 2/1994 | Bourgeois |
| D346,092 | S | 4/1994 | Van de Velde |
| 5,312,011 | A | 5/1994 | Fischer |
| 5,344,023 | A | 9/1994 | Cox et al. |
| 5,383,558 | A | 1/1995 | Wilkinson et al. |
| 5,409,126 | A | 4/1995 | DeMars |
| 5,409,128 | A | 4/1995 | Mitchell |
| 5,531,353 | A | 7/1996 | Ward et al. |
| 5,586,656 | A | 12/1996 | Abrums |
| 5,692,617 | A | 12/1997 | Adams |
| 5,740,914 | A | 4/1998 | Herzog |
| D395,195 | S | 6/1998 | Heiberg et al. |
| 5,769,229 | A | 6/1998 | Andress et al. |
| 5,775,483 | A | 7/1998 | Lown et al. |
| 5,799,792 | A | 9/1998 | Abrums |
| 5,839,598 | A | 11/1998 | Mitchell |
| D417,584 | S | 12/1999 | Lillelund et al. |
| 6,006,943 | A | 12/1999 | Laney |
| 6,015,061 | A | 1/2000 | Lowry |
| 6,142,332 | A | 11/2000 | Ferrara |
| 6,152,318 | A | 11/2000 | Walker |
| 6,158,607 | A | 12/2000 | Wallberg |
| 6,164,483 | A | 12/2000 | Walker |

NESTABLE FOOD STORAGE LIDS AND CONTAINER BASE

FIELD OF THE INVENTION

The invention is generally related to food storage containers, and more particularly to nestable food storage lids that can nest with one another and with a container base.

BACKGROUND OF THE INVENTION

Food storage containers are known that have a bowl or a base that defines a food storage space therein. Many of these types of containers are also known to have a separate lid that can be secured over a top opening of the base to seal contents within the space of the container. In many circumstances, the lid secures to an upper or top edge of the base and can, in conjunction with the top edge of the base, create an air tight seal for the storage space.

One particular difficulty with such food storage containers is in storing both the lids and the bases of the containers when not being used. Another difficulty is in storing the containers in such a way that the lids do not become lost, misplaced, or separated form the bases, and so that an appropriate lid can be located when a particular container base is selected for use.

One solution to the storage problem is to stack a plurality of the bases so that they nest within one another. A bottom of one base is placed within the food storage space of a next adjacent base so that it nests therein. The exposed bottom of the lower most container base can then be nested in another food storage base of a next adjacent container base, and so on. U.S. Pat. Nos. 2,412,325 and 5,692,617 disclose examples of this type of container.

U.S. Pat. Nos. 4,951,832 and 5,184,745 are exemplary of a different type of container nesting. In these examples, container bases of different sizes can nest completely within one another with the smallest base being received in the next largest base and so on. In each of these patents, it also shown that the appropriate lid for each container base of different size is positioned on a bottom of the base and nested together with its base within the next larger sized base.

BRIEF DESCRIPTION OF THE DRAWINGS

Exemplary nestable food storage lids and container bases in accordance with the teachings of the present invention are described and explained in greater detail below with the aid of the drawing figures in which.

DETAILED DESCRIPTION OF THE PREFERRED EMBODIMENTS

Examples of a container constructed in accordance with teachings of the present invention are disclosed herein. Each of these examples generally includes a container base and a lid for the container. The container base is nestable with other container bases and the lid is nestable with other container lids. The lids can nest with the containers in both a right-side up and inverted orientation. The disclosed containers improve upon a number of the problems discussed above with prior known food storage containers.

Figure 1:
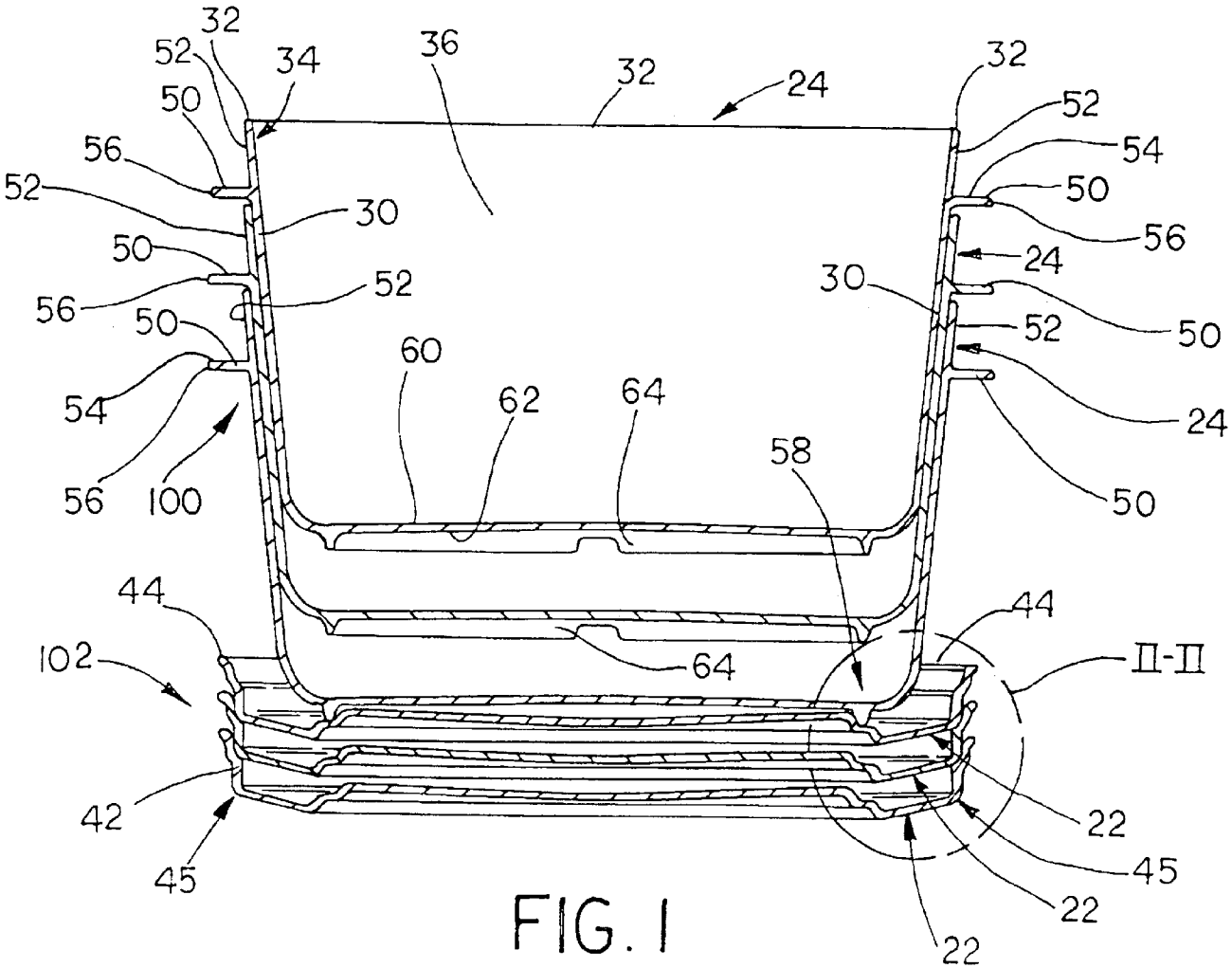
FIG. 1 is a side view in cross section of one example of stacked and nested container bases and lids constructed in accordance with the teachings of the present invention and with the lids in an inverted orientation.
Figure 2:
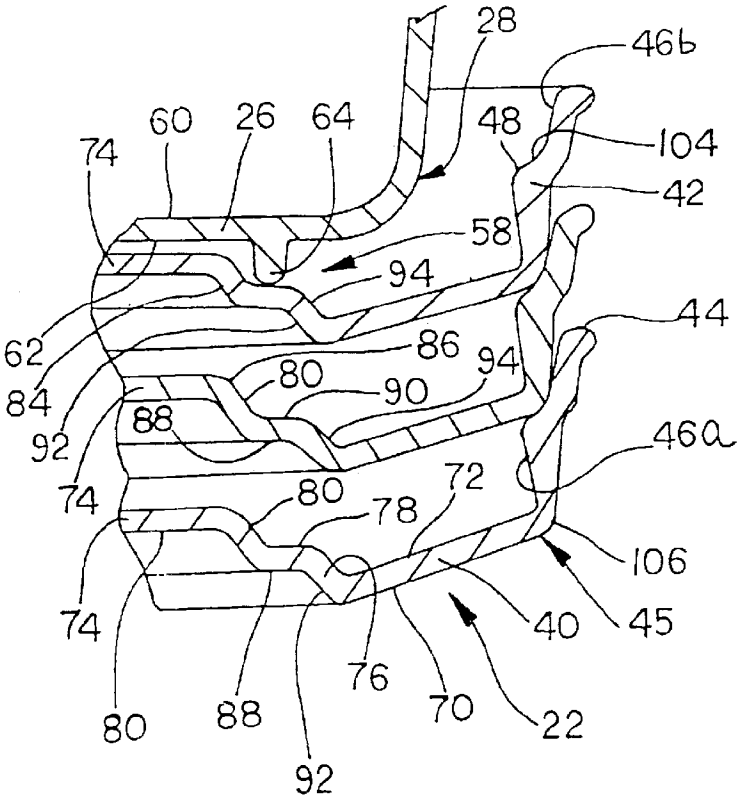
FIG. 2 is an enlarged view taken from circle II—II of the stacked and nested containers shown in FIG. 1.

Referring now to the drawings, FIGS. 1 and 2 show a side view in cross section of a plurality of stacked and nested containers 20. Each container has a lid 22 and a container base 24. In this example, the bases 24 are nested with one another to form a base stack. The lids 22 (see enlarged view shown in FIG. 2) are also nested with one another to form a lid stack which is then positioned beneath the base stack as described in greater detail below. In FIGS. 1 and 2, the lids are oriented upside down (relative to the lid orientation as when installed on a container base) with the underside of the lid facing up. Herein, this upside down orientation is described as the "inverted" lid orientation.

Figure 3:
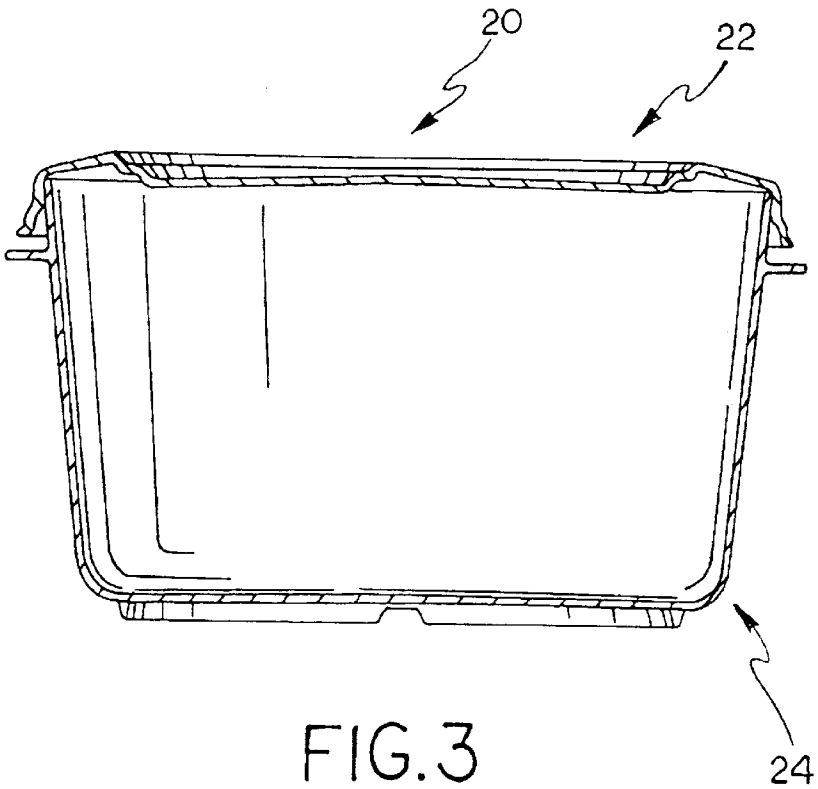
FIG. 3 is a cross section of one of the containers shown in FIG. 1 and with a lid installed on the container base.
Figure 4:
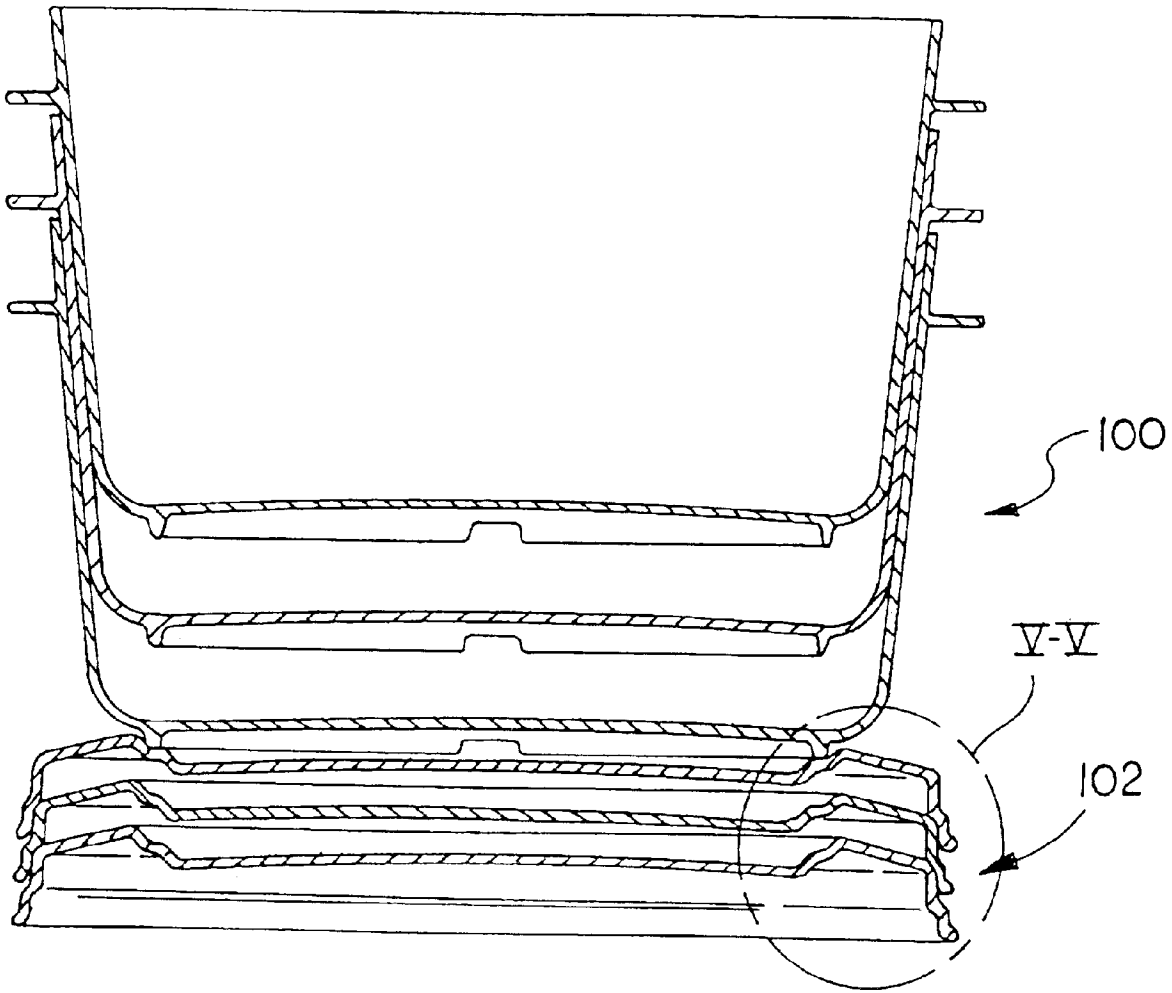
FIG. 4 is a side view in cross section of the nested and stacked containers shown in FIG. 1, but with the lids shown in a standard orientation.

FIG. 3 illustrates one of the containers 20 with the lid 22 installed on the base 24 as during normal use. This lid orientation is described herein as the "standard" lid orientation. FIG. 4 shows a side view in cross section of the plurality of the stacked and nested containers 20. However, in this view the lids 22 are stacked and oriented in the standard lid orientation and then the lid stack is nested beneath the stack of bases 24 (see enlarged view in FIG. 5).

The container base 24 has a bottom panel 26 with a base perimeter 28. A side wall 30 extends continuously around the base perimeter 28 and upward from the perimeter and bottom wall 26. The side wall 30 terminates at a top edge 32 that defines an open top 34 of the container base 24. The open top 34 provides access to an interior food storage space 36 within the bottom panel 26 and side wall 30 of the base 24. The container 20 is an example of an injection molded plastic container.

The container 20 has a generally vertical reference axis "A" that, in this example, is normal or perpendicular to the bottom panel 26. The side wall 30 extends generally upward from the bottom wall and is concentric with the reference axis A. As will be evident to those having ordinary skill in the art, the side wall configuration can be a circular cylinder or can be a non-circular cylindrical shape relative to the axis A. For example, the side wall 30 in this disclosed example generally defines four segments 30*a*, 30*b*, 30*c*, and 30*d* that form a four-sided rectangular or square base, though the four segments are curved slightly radially outward. The side wall 30 and any discrete wall segments, if present, can vary considerably in length, height, curvature, and the like, and yet fall within the spirit and scope of the present invention. Certainly, other configurations and constructions of the base are also possible that are different than those disclosed as examples herein.

As shown in FIG. 3, the lid 22 generally has a top panel 40 and a generally downwardly depending annular skirt 42 that terminates at a bottom edge 44 and extends from a lid perimeter 45 of the top panel. As is generally known, the lid 22 fits snugly over the top edge 32 of the container and covers the open top 34 to close off the open top and seal the storage space 36 when in use. The particular shape and construction of the top panel 40 and the annular skirt 42 can also vary considerably and yet fall within the scope of the present invention and are typically complimentary to the contour of the top edge 32 and base wall 30. Various examples are described herein.

In one disclosed example as shown in FIG. 3, the lid annular skirt 42 has an interior surface with an upper portion 46*a* that is tapered radially inward, and a lower portion 46*b* that flares radially outward. The junction between the portions 46*a* and 46*b* defines an annular interior lip 48 on the interior surface of the skirt 42. The base 24 in this example has an annular rim flange 50 extending radially outward around the side wall 30 near but spaced from the top edge 32. An upper portion 52 of the side wall 30 is defined between an upper surface 54 of the rim flange 50 and the top edge 32. The rim flange 50 also has a perimeter edge 56. When the lid 22 is placed on and received over the top edge 32 of the open top 34, the interior lip 48 snaps over the top edge and bears snugly against the wall portion 52, securing the lid in place on the base 24. The bottom edge 44 of the lid skirt 42 is spaced from the top surface of the rim flange 50.

Figure 5:
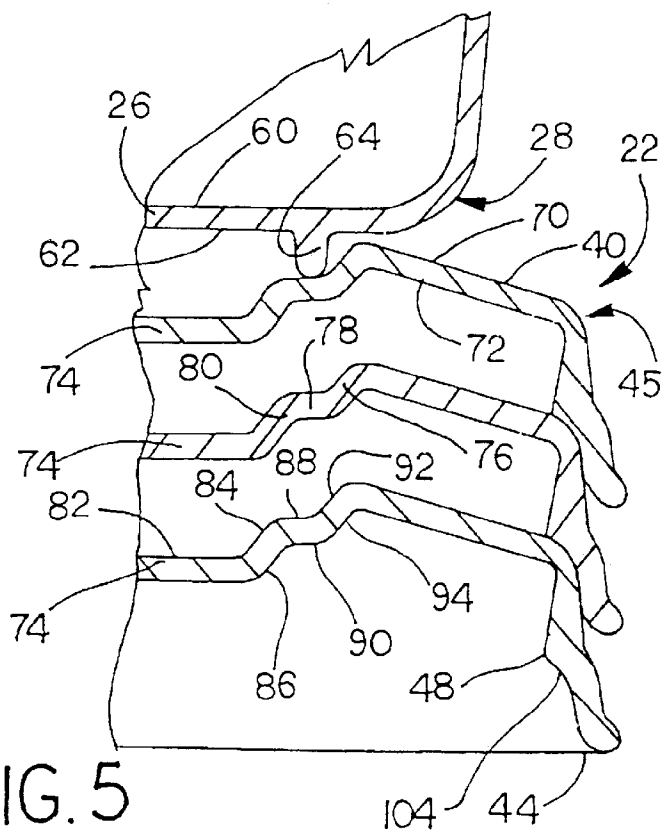
FIG. 5 is an enlarged view taken from circle V—V of a portion of the containers and lids shown in FIG. 4.

Referring now to FIGS. 1, 2, 4, and 5, the lid 22 can be removed from the open top of the base 24 and nested with the bottom panel 26 of the base. The lid can either be in an inverted orientation as shown in FIGS. 1 and 2 or in an installed orientation as shown in FIGS. 4 and 5. In either lid orientation, the lid and base are intended to nest with one another. The inverted lid orientation stack illustrated in FIGS. 1 and 2 and the standard orientation lid stack shown in FIGS. 4 and 5 are both suitable for storage of one or more unused containers 20. Two containers 20 that are filled with food product and have installed lids 22, as shown in FIG. 3, can also be stacked on top of one another when placed in a refrigerator or other storage area. The nesting feature permits the bottom of one container base to locate or register on top of the lid of a container positioned beneath it. This feature assists in preventing a stack of full containers from tipping over, and thus assists in preventing spills or leaks.

Figure 6:
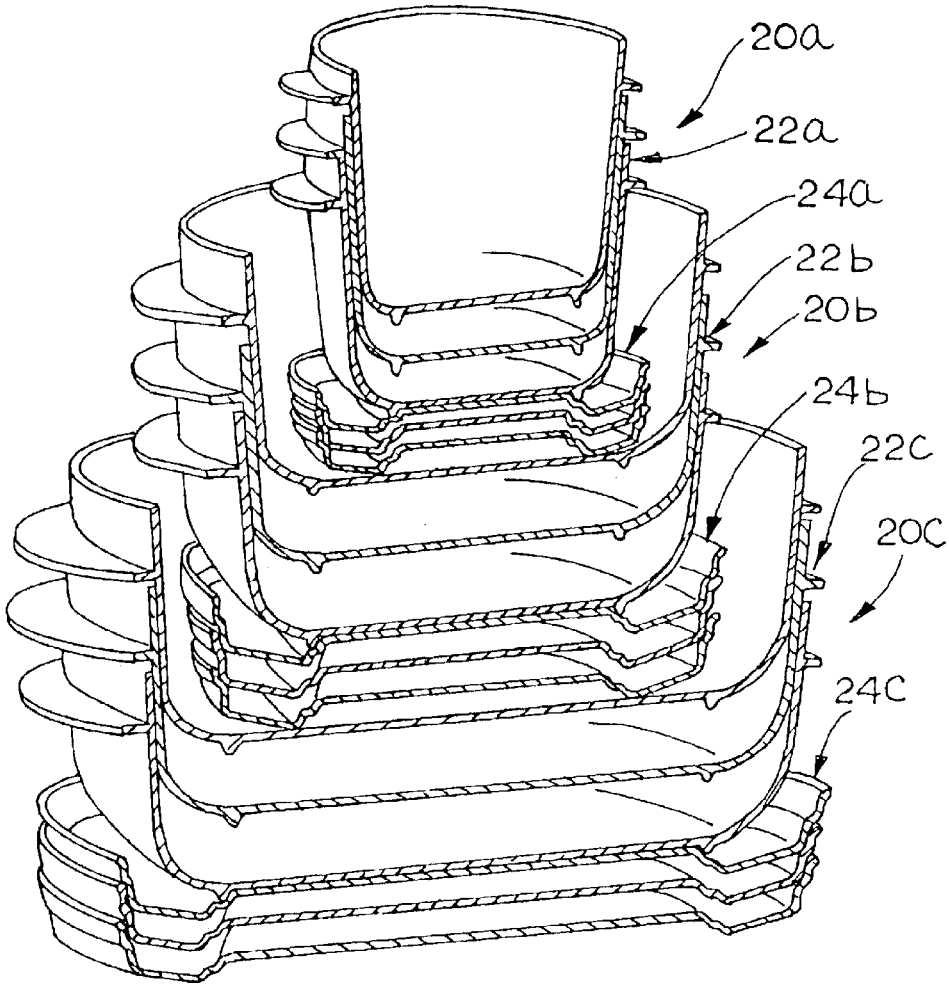
FIG. 6 is a cut-away side view of a plurality of stacked and nested containers of different size.

Ideally, a consumer will have a plurality of containers and lids in varying sizes. All of the containers and lids of different size can nest together to form one stack. FIG. 6 illustrates a plurality of such containers of different size nested together and within one another. A stack of containers 20*a* with lids 22*a* and bases 24*a* are nested with one another, the lids being shown in the inverted orientation. The stack of containers 20*a* is nested within the storage space of a stack of larger size nested containers 20*b* with lids 22*b* and bases 24*b*. Similarly, the stack of containers 20*b* is again nested within the storage space of a stack of larger size nested containers 20*c*. The nestable and stackable containers disclosed herein permit a plurality of containers and lids to be conveniently stacked for space saving. Further, because the lids for each size container can be nested with their corresponding bases, the lids will not become lost and can easily be located for a particular container. Also, the lids can be nested in either the standard or the inverted orientation, as desired, for each stack or sub-stack.

To accomplish nesting between the base and lid, the container 20 has a nesting structure 58 with both the lid 22 and base 24 providing a complementary part of the structure. In the example shown in FIGS. 1–6, the bottom panel 26 of the base 24 has an upper side 60 facing into the storage space 36 and a lower side 62 facing downward. In this example, the disclosed base 24 also has a downwardly depending bottom rib 64 of a contour that can generally follow the contour of the side wall 30 but is spaced interior of the base perimeter 28. The bottom rib 64 extends downward a predetermined distance from the lower side 62 of the bottom panel 26. The rib 64 defines the portion of the nesting structure 58 provided by the base 24.

The top panel 40 of the lid 22 with reference to the standard orientation (FIG. 3) has a top side 70 which faces upward when the lid is installed on the container. The top panel 40 also has a bottom side 72 which faces downward into the storage space 36 when the lid 22 is installed (FIG. 3). The top panel 40 of the lid in the present example also has a recessed surface 74 formed therein. Reference to FIG. 3 reveals that an annular shoulder extends between the depression 74 and the top panel 40. The annular shoulder includes a first shoulder portion 76 and a second shoulder portion 80 each extending downwardly from the top panel 40 and angled or tapered radially inward. A generally horizontally oriented step 78 interconnects the two shoulder portions 76 and 80. The second shoulder portion 80 extends downward to the recessed surface 74 that extends across the remainder of the top panel 40 bounded by the second shoulder portion 80.

As shown in FIGS. 1, 2, 4, and 5, the lid 22 defines a similar step/shoulder configuration whether in the standard orientation or the inverted orientation. Thus, the second shoulder portion 80 has a radially inward facing shoulder surface 84 and an outward facing shoulder surface 86. Similarly, the step 78 has a top step side 88 and a bottom step side 90 (with reference to the standard orientation). Also, the first shoulder portion 76 has an inward facing shoulder surface 92 and an outward facing shoulder surface 94. The recessed surface 74 of the top panel 40 including the shoulder wall and step define the portion of the nesting structure provided by the lid.

As shown in FIGS. 1 and 2, the bottom rib 64 rests on the bottom step side 90 when the lid 22 is in the inverted orientation. The rib 64 of the base bottom panel 26 in this lid orientation is spaced outward of the outward facing shoulder surface 86 of the second shoulder portion 80. The base 24 is prevented from sliding relative to the lid 22 in this orientation by the shoulder surface 86 and is supported by the step 78.

As shown in FIGS. 4 and 5, the rib 64 rests on the top step side 88 of the step 78 when the lid is in the standard orientation. The rib 64 of the base bottom panel 26 in this orientation is spaced inward of the inward facing shoulder surface 92 of the first shoulder portion 76. The rib 64 is bounded by the shoulder surface 92 which prevents the base 24 from sliding relative to the lid. The nesting structure 58 therefore permits the base 24 to nest with the lid 22 in either the inverted orientation or the standard orientation as desired.

In the example disclosed in FIGS. 1, 2, 4, and 5, a plurality of the bases 24 are shown nested with one another. Each base 24 is disposed in an identical orientation as the other bases 24 and deposited successively within the storage space 36 of a next adjacent base 24 to form a base stack 100. In one example, the depth of nesting between adjacent bases 24 of the stack 100 is created by a height of the bottom rib 64 of one base, which bears against the upper side 60 of a bottom panel 26 of an adjacent base 24. Alternatively, and as shown in FIG. 1, the depth of nesting between adjacent bases 24 can be determined by the length of the wall portion 52 between the upper surface 54 of the rim flange 50 and the top edge 32 of the base wall 30.

Also as shown in FIGS. 1, 2, 4, and 5, the disclosed lids 22 can nest with one another to form a lid stack 102. To accomplish nesting of a plurality of the lids 22 in this example, each lid 22 has an annular ledge 104 extending around and provided on the inner surface of the lid skirt 42 between the lip 48 and the flared inner surface portion 46*b*. In this example, the ledge 104 faces generally downward with reference to the standard orientation and radially inward relative to the reference axis A. The surface of the ledge 104 can be contoured as desired but is intended to bear against a correspondingly contoured exterior skirt surface of an adjacent lid 22. In this example, the lid perimeter 45 is provided at the junction between the top panel 40 and the lid skirt 42 and defines an exterior corner 106 at the lid perimeter 45. The contour of the corner 106 mates with the contour of the ledge 104 as shown clearly in FIGS. 2 and 5. As will be evident to those having ordinary skill in the art, the construction of the nesting feature for a plurality of the lids 22 can vary in configuration and construction and yet fall within the scope of the present invention.

Figure 8:
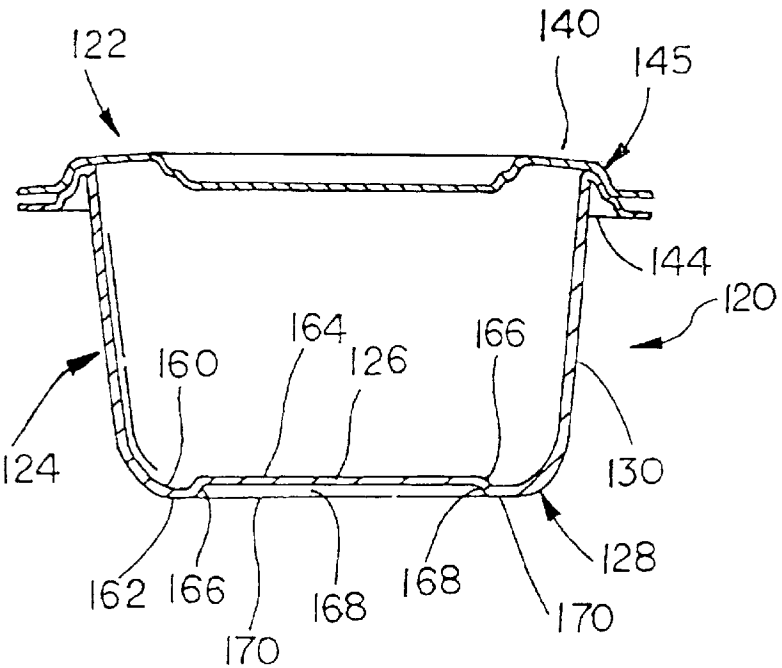
FIG. 8 is a cross section taken along line VIII—VIII of the container shown in FIG. 7.
Figure 7:
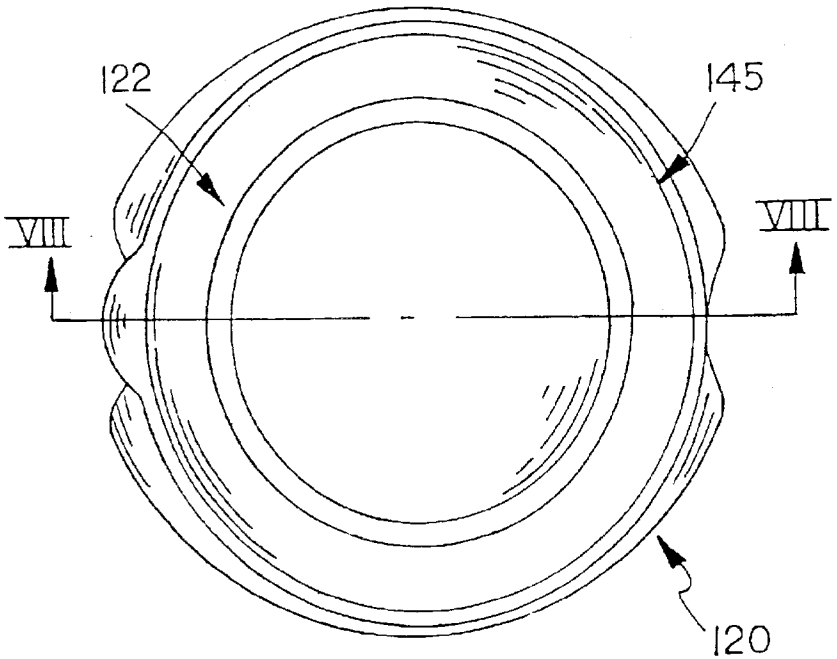
FIG. 7 is a top view of another example of a container with the lid installed and constructed in accordance with the teachings of the present invention.

Referring now to FIGS. 7 and 8, another example of a nestable and stackable container 120 is illustrated and has a lid 122 and a base 124. The container 120 is an example of a thermo-formed plastic container. The container 20 described above can be formed by, for example, an injection molding process. In this example, the thermo-formed base 124 has a bottom panel 126, a base perimeter 128, and a base side wall 130 that again terminates at a top edge 132. The top edge 132 defines an open top 134 providing access to a storage space 136 within the interior of the base 124. The container 120 in this example has a circular cylinder shaped side wall configuration. The lid 122 has a top panel 140 with a downwardly depending lid skirt 142 with reference to the standard orientation. The skirt 142 terminates at a bottom edge 144 and is joined to the top panel 140 at a lid perimeter 145.

In the disclosed example shown in FIGS. 7 and 8, the lid annular skirt 142 has an interior surface 146 with a radially inward protruding annular lip 148. The base 124 in this example has a rolled annular rim 150 that extends radially outward and downward from the top edge 132 around the side wall 130. The rim 150 also has a radially outwardly extending rim flange 152. An exterior surface 154 of the rim 150 has a complementary annular recess or groove 156 formed therein. When the lid 122 is placed on and received over the top edge 132 of the open top 134, the lip 148 snaps into the groove 156, securing the lid in place on the base 124.

Referring now to FIGS. 9–12, the bottom panel 126 of the base 124 can nest with the lid 122 with the lid either in the inverted orientation or the standard orientation. A lid portion of a nesting structure 158 in this example is essentially identical to that of the lid 22 of the prior example and reference is had to the related description above and to FIGS. 1, 2, 4, and 5. Therefore, like reference numbers shown in FIGS. 9–12 refer to like parts of the nesting structure 58 shown in FIG.

The base portion of the nesting structure 158 provided on the bottom panel 126 of the base 124 is slightly different than that described in the previous example because of its thermo-formed construction. The base does not have a rim or rib such as the rib 64 in the prior example. Such a rib cannot be formed easily in a thermo-forming process. In this example, the bottom panel 126 has an upper side 160 facing the storage space 136 and a lower side 162 relative to the standard orientation of the lid 122. The lower side has an upward recess 164 formed in the bottom panel 126. An annular shoulder 166 joins the recess 164 to the remainder of the bottom panel 126 and has a radially inward facing shoulder surface 168. The bottom panel 126 merges into the side wall 130 at the base perimeter 128 near but radially outward of the recess 164 and shoulder 166. Between the upward depression 164 and the base perimeter 128, the lower side 162 defines an annular leg 170.

Figure 10:
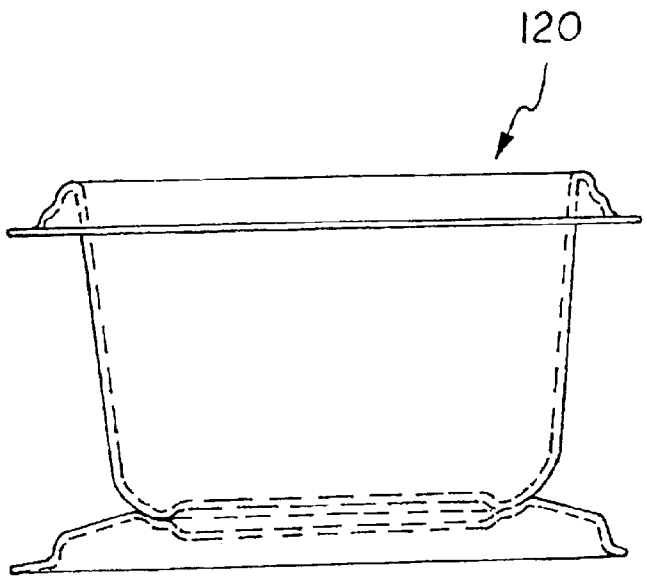
FIG. 10 is a side view in cross section of the container shown in FIG. 7 and with the lid positioned beneath the base in a standard orientation.
Figure 9:
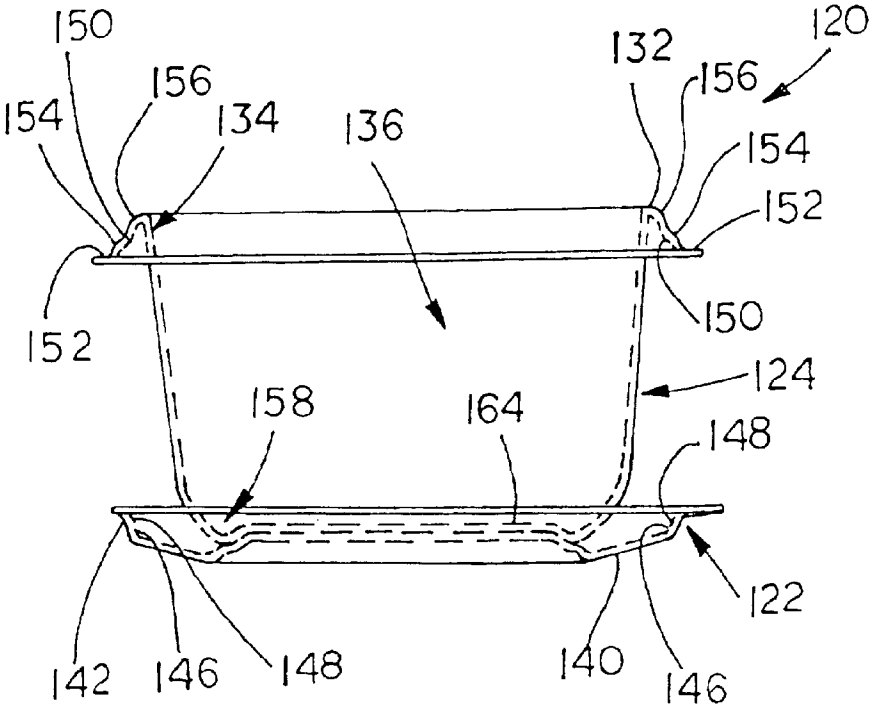
FIG. 9 is a side view in cross section of the container shown in FIG. 7 and with the lid positioned beneath the base in an inverted orientation.

The leg 170 of the base 124 rests on the step top surface 88 as shown in FIG. 10 when the lid 122 is in the standard orientation. The leg 170 rests on the step bottom surface 90 when the lid 122 is in the inverted orientation as shown in FIG. 9. When in the standard orientation of FIG. 10, the inwardly facing shoulder surface 92 of the first shoulder wall 76 is positioned radially outward of the leg 170 and prevents the container from sliding relative to the lid top panel 140. When in the inverted orientation of FIG. 9, the outwardly facing shoulder surface 86 of the second annular shoulder wall 80 bears against the inward facing surface 168 of the shoulder wall 166 in the base bottom panel 126. This prevents the base from sliding relative to the lid in this inverted nested orientation.

Figure 12:
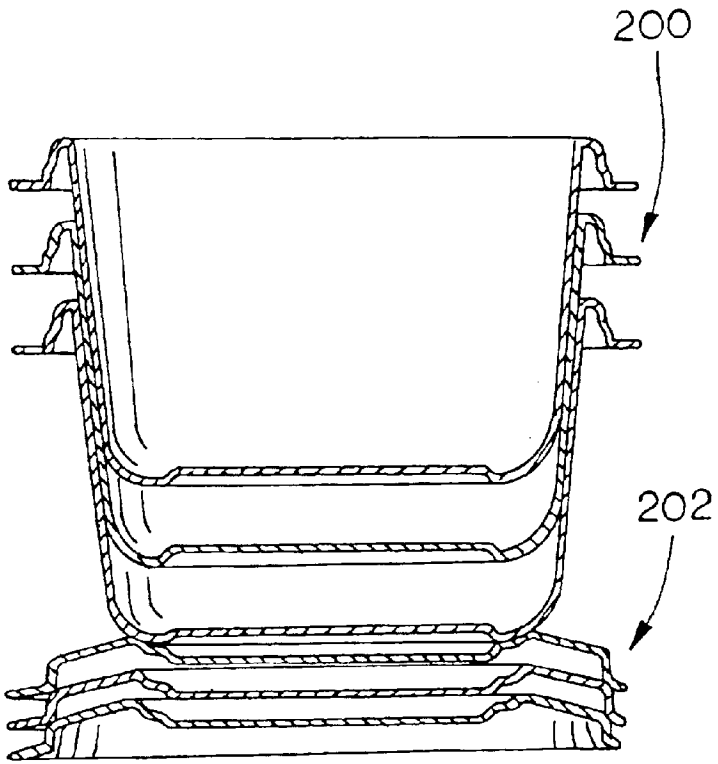
FIG. 12 is a side view in cross section of a plurality of stacked and nested containers as shown in FIG. 10.
Figure 11:
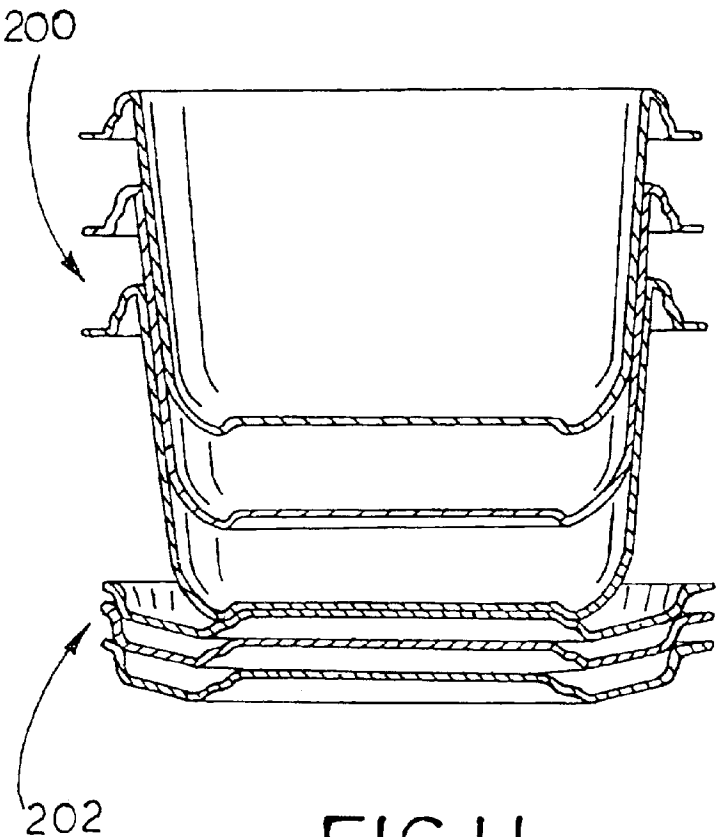
FIG. 11 is a side view in cross section of a plurality of stacked and nested containers as shown in FIG. 9.

FIGS. 11 and 12 illustrate a plurality of the bases 124 and lids 122 nested and stacked. FIG. 11 shows a stack 200 of the bases 124 nested with a stack 202 of the lids 122 in the inverted orientation. FIG. 12 shows a stack 200 of the bases nested with a stack 202 of the lids 122 in the standard orientation. FIGS. 11 and 12 again illustrate that the lids 122 can be adapted to nest with one another. In this example, the lip 148 of one lid nests in the groove 156 of an adjacent lid and the inner surface 146 of the skirt 142 of the one lid bears against the rolled rim 150 of the adjacent lid.

Aside from nesting and stacking multiple containers for storage, the containers disclosed herein provide other advantages as well. As illustrated in FIG. 10, for example, a lid 122 can be nested in its standard orientation with a bottom of its corresponding base 124 to provide a sturdy and stable support for the base. In such a configuration, the container 120 can be utilized for serving food directly from the base 124. The containers and bases can also be stored in stacks with the lids in this standard orientation to provide a stable stack of containers, if so desired. As noted above, a full container can also be stacked for storage in a refrigerator or other storage area by registering on top of a lid of another full container.

Although certain nestable food storage lids and container bases have been disclosed and described herein in accordance with the teachings of the present invention, the scope of coverage of this patent is not limited thereto. On the contrary, this patent covers all embodiments of the teachings of the invention fairly falling within the scope of the appended claims, either literally or under the doctrine of equivalents.

What is claimed is:

1. A food storage container comprising:

a base having a base bottom panel with an upper side, a lower side, and a base perimeter, and having a cylindrical side wall extending generally upward from the base perimeter, the side wall terminating at a top edge and defining an open top;

a lid having a top panel with a top side, a bottom side, and a perimeter terminating at a bottom edge, the top panel extending inwardly from the perimeter toward a center portion of the top panel, the top panel also having a first shoulder spaced inward from and around the perimeter and extending angularly downward relative to the top side, a first step extending inwardly from the first shoulder toward the center portion of the lid, a second shoulder extending angularly downward from the first step relative to the top side, and a recessed surface extending inwardly from the second shoulder forming the center portion of the top panel; and a nesting structure provided at least in part on a portion of the base bottom panel and at least in part on the lid top panel, the nesting structure adapted for registering a portion of the lower side of the base with a portion of the lid top panel both when the lid is in a standard lid orientation and when the lid is in an inverted lid orientation.

2. A food storage container according to claim 1, wherein the base is nestable with other bases of other containers to form a base stack, and wherein an exposed lower most base of the base stack is registerable with the lid in either lid orientation.

3. A food storage according to claim 1, wherein the lid is nestable with other lids of other containers to form a lid stack, and wherein a selected one of an upper most exposed lid and a lower most exposed lid of the lid stack is registerable with the lower side of the base.

4. A food storage container according to claim 2, wherein the lid is nestable with other lids of other containers to form a lid stack, and wherein a selected one of an upper most exposed lid and a lower most exposed lid of the lid stack is registerable with the exposed lower most base of the base stack.

5. A food storage container according to claim 1, wherein the side wall is a generally circular cylinder.

6. A food storage container according to claim 5, wherein the side wall is at least a slightly frusto-conical circular cylinder.

7. A food storage container according to claim 1, wherein the side wall is a generally rectangular cylinder.

8. A food storage container according to claim 1, wherein the nesting structure part of the base is a depending annular element extending downward from the base bottom panel that can rest on a selected one of a step top surface or a step bottom surface provided between the first and second shoulder portions.

9. A food storage container according to claim 8, wherein the depending annular element is a rib extending from the lower side of the bottom panel.

10. A food storage container according to claim 8, wherein the lower side of the bottom panel has an upwardly recessed section defining the depending annular element as a leg in the lower side between the recessed section and the base perimeter.

11. A food storage container according to claim 1, wherein the nesting structure further comprises:

a first area on the lid for supporting an adjacent lid in a stacked lid configuration; and a second area on the lid for supporting a base in a stacked lid and base configuration when the lid is in a standard orientation;

a third area on the lid for supporting a base in a stacked lid and base configuration when the lid is in an inverted orientation.

12. A food storage container according to claim 1, wherein the second area includes an inner shoulder surface that extends substantially continuously around a perimeter of the lid, the inner shoulder surface adapted to register with a portion of the base when the base is stacked upon the lid in the standard orientation.

13. A food storage container according to claim 1, wherein the third area includes an outward facing shoulder surface that extends substantially continuously around a perimeter of the lid, the outward facing shoulder surface adapted to register with a portion of the base when the base is stacked upon the lid in the inverted orientation.

* * * * *